US006508089B1

(12) United States Patent
Tsai

(10) Patent No.: US 6,508,089 B1
(45) Date of Patent: Jan. 21, 2003

(54) LOCK USED FOR THE CABINETS IN PUBLIC PLACES

(75) Inventor: Cheng-Tao Tsai, Tainan (TW)

(73) Assignee: Jaeyou Co., Ltd., Tainan (TW)

( * ) Notice: Subject to any disclaimer, the term of this patent is extended or adjusted under 35 U.S.C. 154(b) by 0 days.

(21) Appl. No.: 10/106,497

(22) Filed: Mar. 27, 2002

(51) Int. Cl.[7] ..... E05B 13/10
(52) U.S. Cl. ..... 70/213; 70/284; 70/285; 70/312
(58) Field of Search ..... 70/213, 219, 284, 70/285, 312

(56) References Cited

U.S. PATENT DOCUMENTS 4,671,088 A * 6/1987 Jeang ..... 70/312
4,770,013 A * 9/1988 Nakai ..... 70/285
4,885,923 A * 12/1989 Nakai ..... 70/284
5,020,346 A * 6/1991 Eisermann ..... 70/285
5,237,842 A * 8/1993 Rasch et al. ..... 70/285
5,345,798 A * 9/1994 Nakai ..... 70/284
5,485,734 A * 1/1996 Yang ..... 70/285
5,661,991 A * 9/1997 Hsu ..... 70/312
6,439,006 B1 * 8/2002 Tsai ..... 70/28

* cited by examiner

*Primary Examiner*—Lloyd A. Gall
(74) *Attorney, Agent, or Firm*—Rosenberg, Klein & Lee

(57) ABSTRACT

The present invention relates to a lock used for the cabinets in public places, in which the number of lock can be reset when used to secure the items of users.

4 Claims, 12 Drawing Sheets

LOCK USED FOR THE CABINETS IN PUBLIC PLACES

BACKGROUND OF THE INVENTION

The present invention relates to a lock used for the cabinets in public places, more particularly a lock, which takes the form of a combination lock, and of which the combination of numbers can be reset by the present user.

Storage cabinets are provided for customers to keep their personal objects in public places such as railway stations, swimming pools, shopping centers, and spas. The storage cabinets are usually equipped with a lock such that they can prevent the personal objects of the customers from being stolen when the customers keep the objects in them. The customers can lock those objects in the cabinets that are not needed while they are getting service in the public places, and only have to carry a key for the lock of the cabinets with them. Therefore, the storage cabinets are very convenient to use.

However, such cabinets are found to have a disadvantage because of the type of the locks that they are provided with; the customers might lose the key for the lock while they are getting service in the public places, causing themselves a lot of trouble; and, a thief can pretend to store his personal objects in the cabinets in order to get the key for the lock, and have the key reproduced such that he can open the lock with the reproduced key to steal other people's objects some other time.

SUMMARY OF THE INVENTION

Therefore, it is a main object of the present invention to provide a lock for a cabinet in public places, which takes the form of a combination lock, and of which the combination of numbers for opening it can be reset by the present user.

It is an other object of the present invention to provide the combination lock such that the cabinet can be opened by a spare key kept in the counter should the user forget the combination of numbers that he set, and that the forgotten combination of numbers can be found out by a probing needle.

The combination lock of the present invention includes a housing member, several control rings each separably engaged with a wheel, a lock rod, a control block and an operating rod.

The wheels are turnably disposed in the housing members, and are each marked with spaced numerals on the outer side. The control rings each has spaced projections on the outer side to engage spaced teeth on the inner side of the wheel. The control rings each has a through hole formed with both a central round portion and a square portion.

The lock rod is passed through the control rings from a rod part that has spaced projections, each of which sticks rearwards and has gap. A spring is disposed under a lowermost one of the control rings to bias same up.

The control block has a centrol hole formed lengthwise therein and several concavely curved portions lengthwise formed on the outer side that include a first one and a second one shallower than the first one. The control block is lengthwise passed through an upper portion of the housing member to abut a curved propping block placed on an uppermost one of the control rings.

The operating rod is passed through the control hole of the control block from a middle rod portion, and has a front knob sticking out from the front side of the housing, and is connected to locking plate at the rear end. The middle rod portion engages the control block, and can be disengaged from same when a spare key is inserted into the keyhole of the operating rod.

Thus, the control rings can be pressed down and disengaged from the wheels when the control block is turned together with the operating rod to abut the propping block at the shallow second curved portion thereof allowing the wheels to be turned relative to the control rings for resetting the unlocking combination of numbers. When the control rings are biased by the spring to engage the wheels, and the wheels are turned randomly with the control block abutting the propping block at the first deep curved portion, the lock is locked and the locking plate keeps the cabinet door closed.

DETAILED DESCRIPTION OF THE PREFERRED EMBODIMENTS

Figure 1:
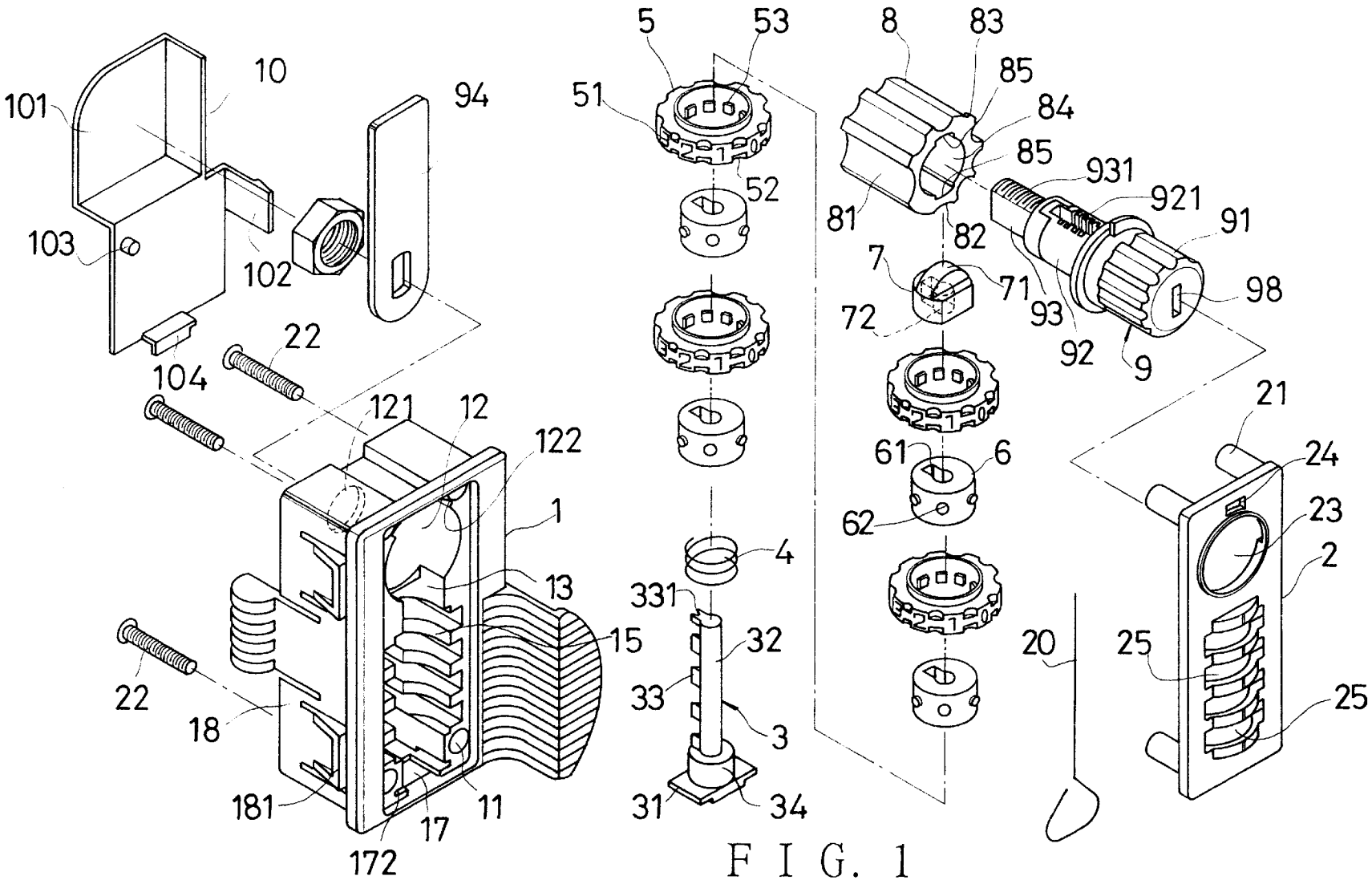
FIG. 1 is an exploded perspective view of the combination lock of the present invention.
Figure 2:
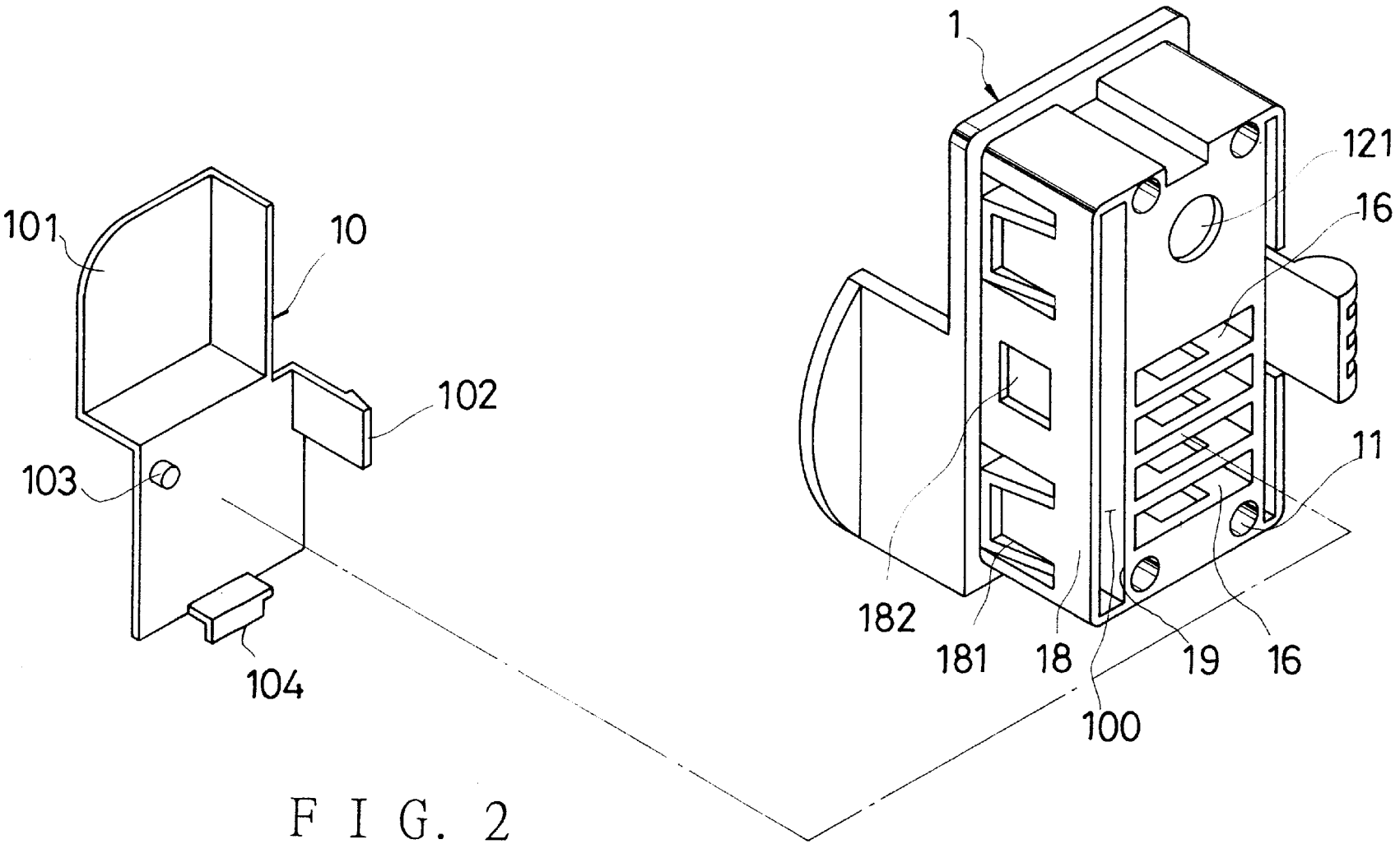
FIG. 2 is a perspective view of the housing member and the panel of the combination lock of the present invention.

Referring to FIGS. 1 and 2, a lock used for the depository cabinet in public places of the present invention includes a housing member 1, a panel 2, a lock rod 3, a spring 4, several wheels 5, control rings 6, a propping block 7, a control block 8, an operating rod 9 and a back board 10.

The housing member 1 has connecting holes 11 at the corners, a round holding room 12 at the upper portion, a gap 13 formed at the bottom of the holding room 12, an inner wall 19, an outer wall 18, several separating boards 15 spaced out from under the holding room 12 to the lower end thereof a bottom hole 17 at the bottom, and elastic tenons 181 provided on the outer walls 18; a through passage hole 121 is formed on the center of the rear wall of the holding room 12; a restricting trench 122 is formed on the upper side of the holding room 12; the separating boards 15 are shaped to have gaps (not numbered) such that the lock rod 3 can be passed therethrough, and the control rings 6 can be received in the gaps when moved down in operation of the lock; a space 100 (FIG. 2) is provided between the inner and the outer walls 19 and 18; two engaging trenches 172 are formed at the lower end portion of the housing member to oppose each other beside the bottom hole 17; a curved trench 171 is formed on the lower end portion of housing member 1 behind the bottom hole 17; a lateral connecting hole 182 is formed on the outer wall 18. The housing member 1 further has flexible legs 14, each of which sticks out from the lateral sides into between two adjacent ones of the separating boards 15, and each of which has a convexly curved blocks 141 at the inward end. Many elongated holes 16 are formed on the rear side of the housing member 1 due to the separating board 15 as shown in FIG. 2.

The back board 10 is folded to have a recess 101 at the upper portion, and has a locating pole 103, an insertion protrusion 104, and a connecting hook 102, which all stick out from the lower portion thereof. The back board 10 is fitted to the housing member 1 with the locating pole 103 being passed into the uppermost one of the elongated holes 16, the insertion protrusion 104 being passed through the lowermost one of the elongated holes 16 to engage the lowermost one of the separating board 15, and with the connecting hook 102 being passed into the space 100 to engage the lateral connecting hole 182 of the outer wall 18.

The housing member 1 is secured to the door of a depository cabinet by means of fitting the elastic tenons 181 thereof into mortises provided on the depository cabinet door.

The panel 2 has connecting poles 21 on the rear side, a round hole 23 on the upper portion, an inspection hole 24 above the round hole 23, and several slots 25 spaced out from below the round hole 23 to the lower end portion thereof; the connecting poles 21 each as a screw hole on the rear end. The panel 2 is, after the wheels 5 have been disposed in the housing member 1, secured to the front side of the housing member 1 with the connecting poles 21 being passed into a respective one of the connecting holes 11 of the housing member, and with the round hole 23 opposing the holding room 12 and the slots 25 facing a corresponding one of the spaces between the separating boards 15; screws 22 are screwed into the screw holes of the connecting poles 21 from the rear side of the housing member 1 to prevent the panel 2 from falling off.

Figure 3:
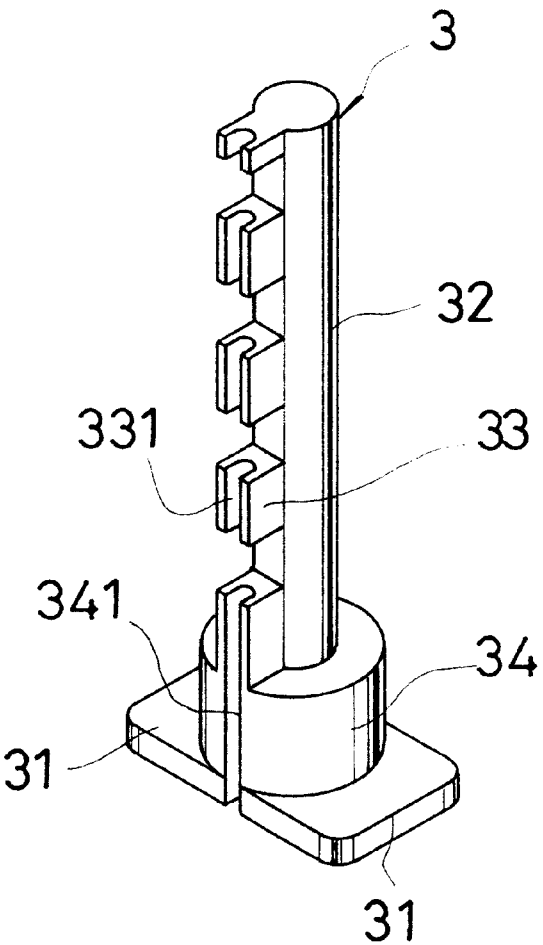
FIG. 3 is a perspective view of the lock rod of the combination lock of the present invention.

The lock rod 3 has an insertion plate 31 on the bottom, a root part 34 on the insertion plate 31, and a rod part 32 sticking up from the root part 34. Referring to FIG. 3, the lock rod 3 is formed with several projections 33 spaced out on the rear side of the rod part 32, each of which has a gap 331 extending from the top to the bottom. A gap 341 is formed on the rear side of the root part 34 and the insertion plate 31 to be aligned with the gaps 331 such that an upright passage is formed on the rear side of the lock rod 3. The rod part 32 of the lock rod 3 is passed through the gaps of the separating boards 15 with the projections 33 being opposite the rear side of the housing member 1, and the insertion plate 31 is inserted into the engaging trenches 172 from two ends.

The spring 4 is passed around the lock rod 3 to be disposed at the lower portion of the same.

The wheels 5 each has engaging teeth 53 spaced out on the inner side, and is marked with spaced out numerals (0 to 9) 51 on the outer side; curved recesses 52 are formed on both the upper and the lower portions of the spaces between the numerals 51.

The control rings 6 are each separably fitted into a respective one of the wheels 6, and each has a through hole 61 and engaging projections 62 spaced out on the outer side; the through hole 61 includes a round portion on the center of the ring 6 and a square portion next to the round portion; the engaging projections 62 engage the teeth 53 of the corresponding wheel 5 such that each of the control rings 6 can be turned together with the corresponding wheel 5 when it is fitted into the same.

The wheels 5 are disposed in the gaps of the separating boards 15, and kept separate from each other by the separating boards 15 such that the front portions of the wheels 5 stick out through the slots 25 of the panel 2 for allowing a user to turn the wheels in operation of the lock. The rod part 32 is passed through the wheels 5 and the through holes 61 of the control rings 6 such that the control rings 6 are biased up by the spring 4 to be received in the respective wheels 5; when the control rings 6 are pressed downwards to become separate from the wheels, the engaging projections 62 no longer engage the teeth 53 of the wheels 5, following the orientation of the square portions of the through holes 61 of the same in relation to the wheels 5 to be changed by turning the wheels 5 about the lock rod 3 relative to the same.

The propping block 7 has a propping top 71 having a convexly curved surface, and an engaging hole 72 on the lower side that also has a round portion and a square portion next to the round portion. The propping block 7 is disposed on the uppermost one of the control rings 6, and fitted around the top end of the lock rod 3 from the engaging hole 72; thus, the uppermost rearward projection 33 of the lock rod 3 is received in the square portion of the hole 72.

The control block 8 is substantially shaped like a hollow cylinder that has a central hole 84, and several concavely curved portions lengthwise formed on the outer side thereof, the concavely curved portions include a first one 81 and a second one 82 that is shallower than the first one 81. The angle defined by both the normal to the bottom of the first concavely curved portion 81 and the normal to the bottom of the second one 82 is 90. The control block 8 further has a pair of opposing trenches 85 on the inner side, one of which is on the opposite side of the second concavely curved portion 82, and has a restricted projection 83 on the outer side. The control block 8 is turnably passed into the holding room 12 of the housing member 1 with the outer side coming into contact with the propping top 71 of the propping block 7; when the first concavely curved portion 81 faces the propping top 71, the propping block 7 is not moved down by the control block 8, and the control rings 6 are engaged with the wheels 5; when the second concavely curved portion 82 that is shallower than the first one 81 faces the propping top 71, the propping block 7 is moved down, making the control rings separate from the wheels 5. In addition, the restricted projection 83 will be confined in the restricting trench 122 of the holding room 12 of the housing member such that the turning movement of the control block 8 is limited.

Figure 4:
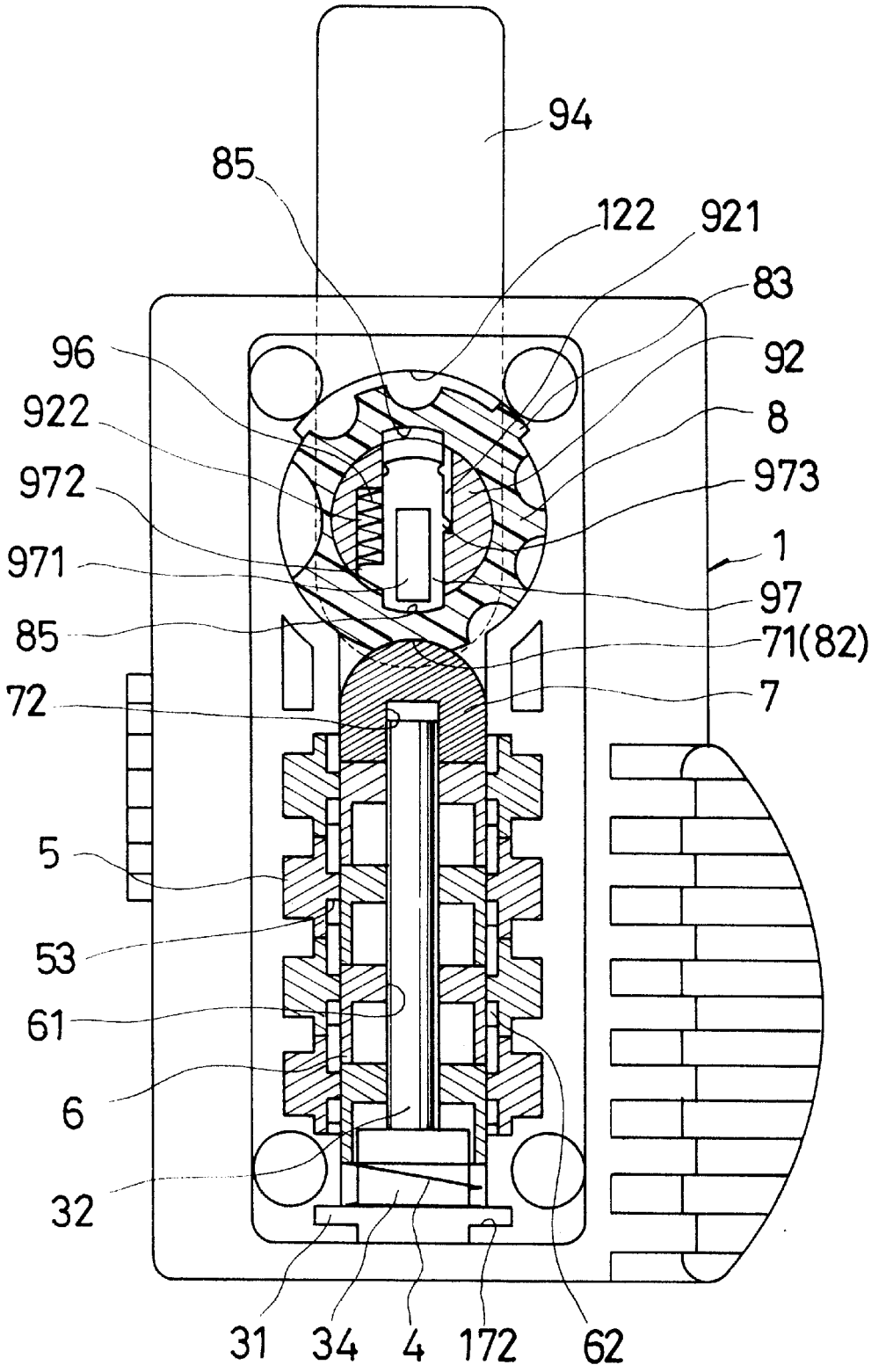
FIG. 4 is a front view of the combination lock of the present invention in the unlocked position.
Figure 5:
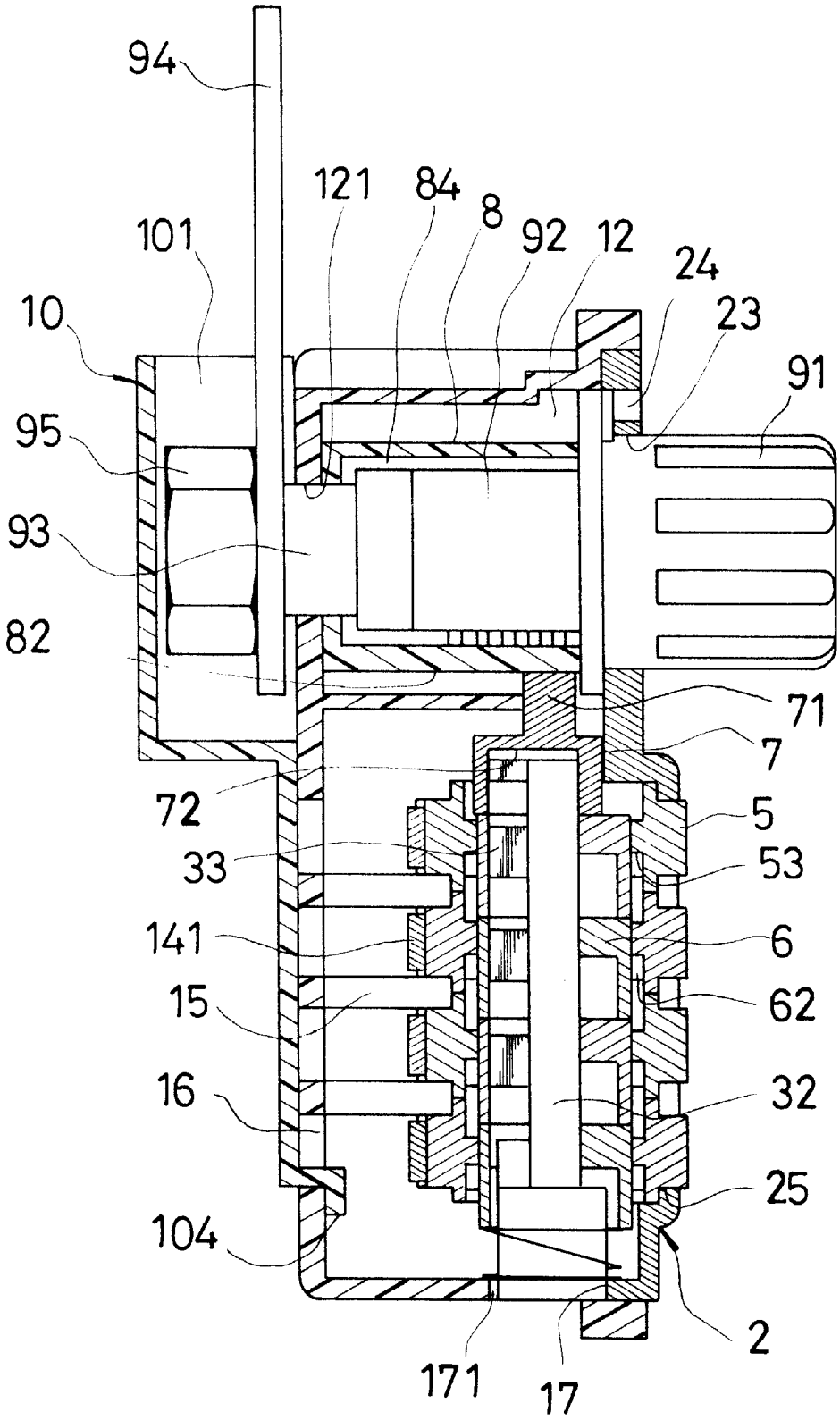
FIG. 5 is a side view of the combination lock of the present invention in the unlocked position.
Figure 6:
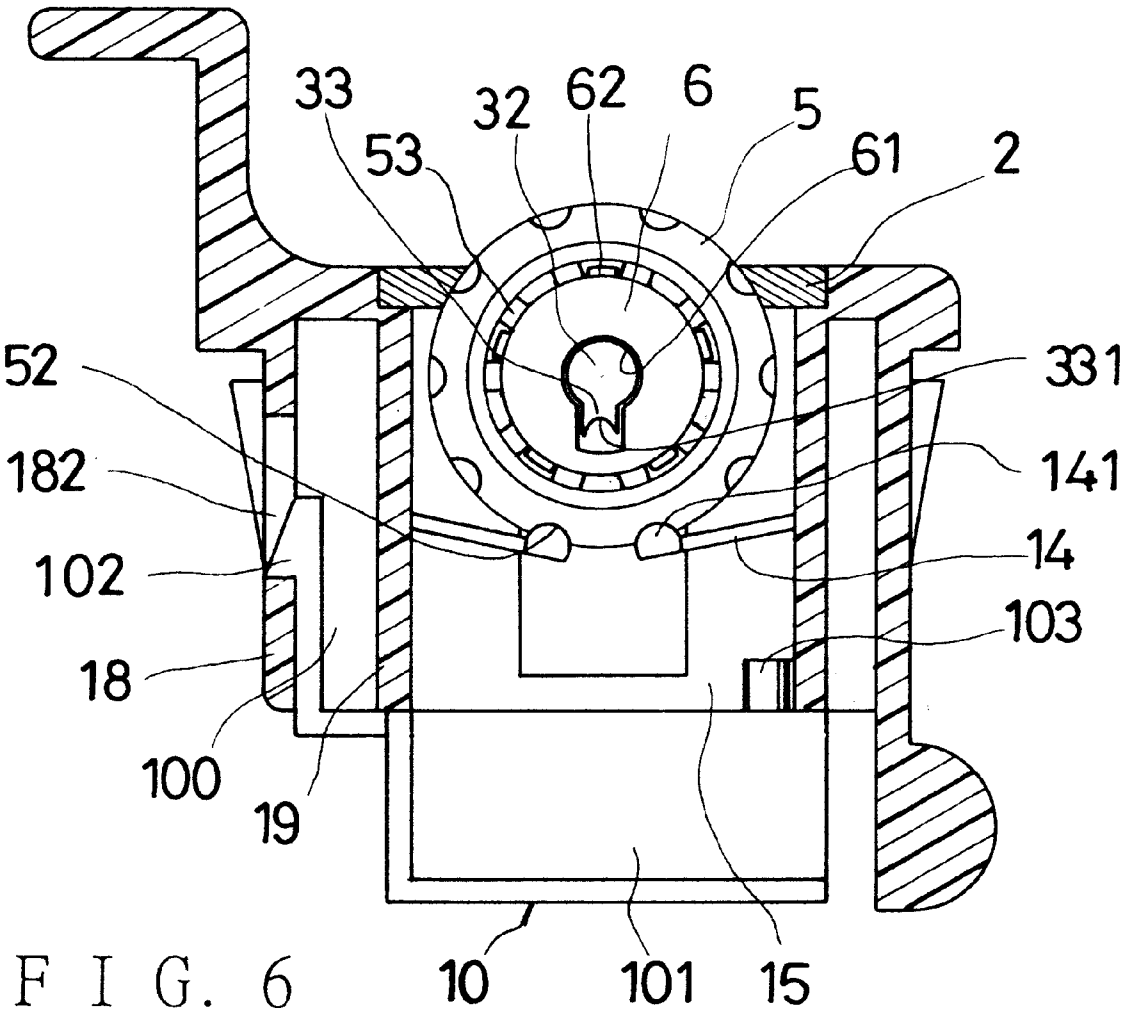
FIG. 6 is a bottom view of the combination lock of the present invention in the unlocked position.
Figure 7:
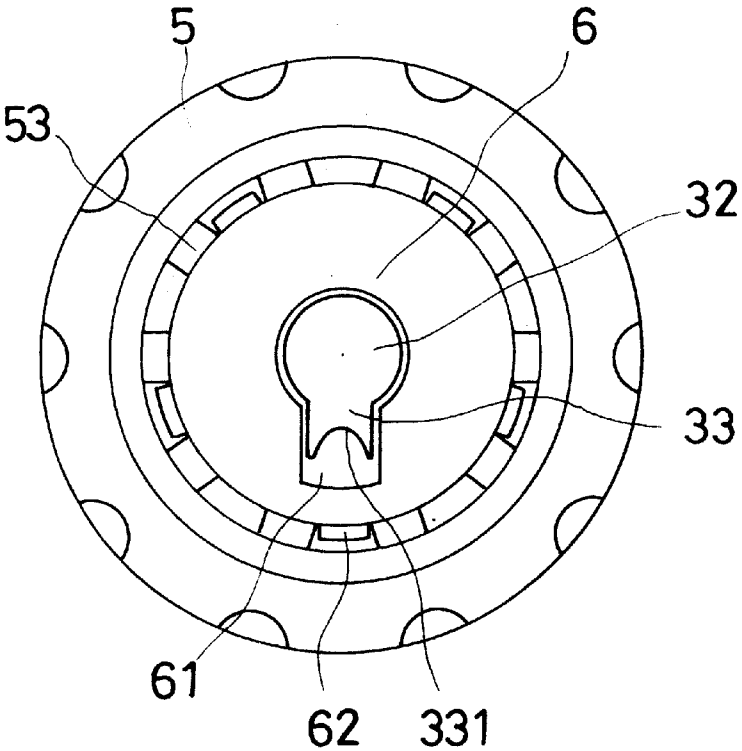
FIG. 7 is a view showing the orientation of the control rings in relation to the lock rod in the unlocked position according to the present invention.
Figure 10:
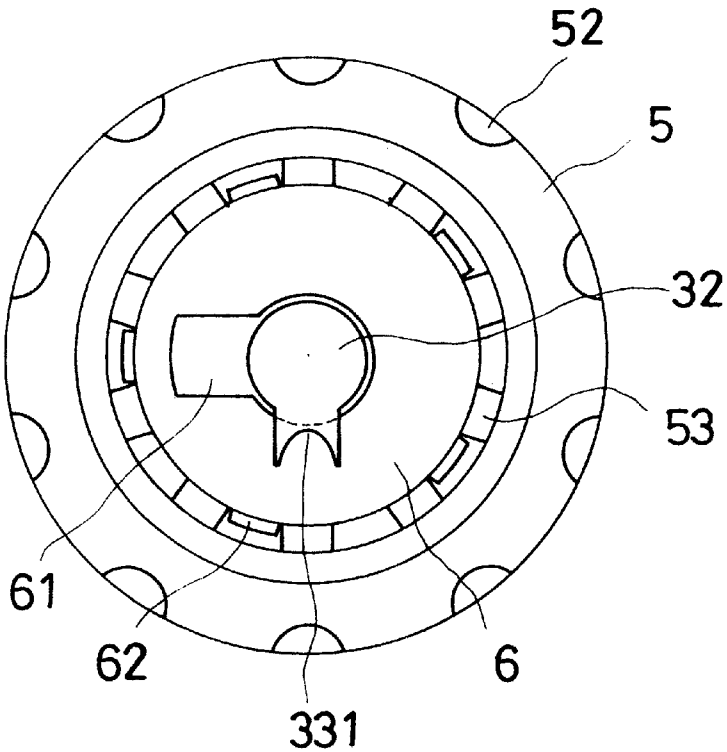
FIG. 10 is a view showing the orientation of the control rings in relation to the lock rod in the locked position according to the present invention.
Figure 8:
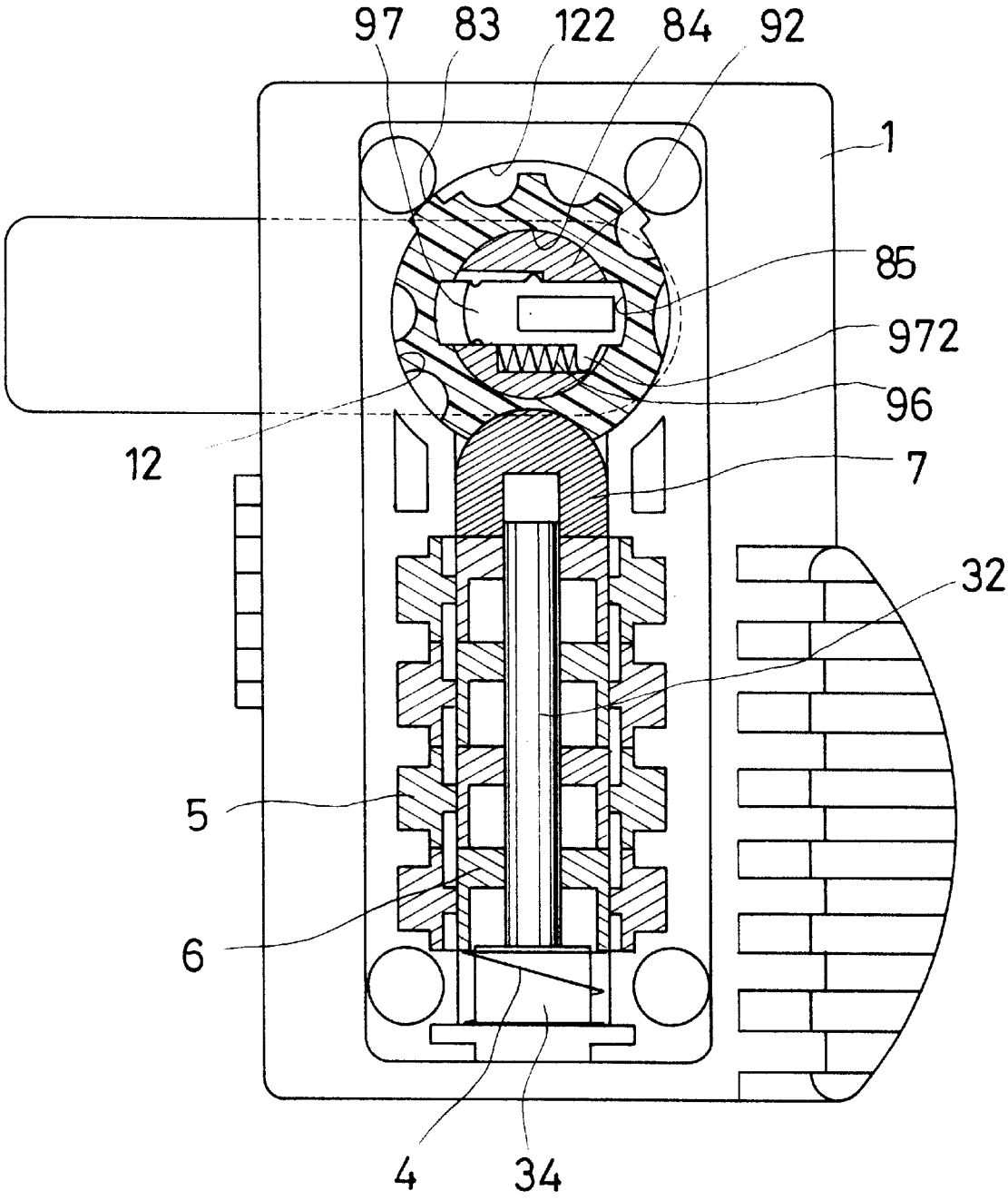
FIG. 8 is a front view of the combination lock of the present invention in the locked position.
Figure 9:
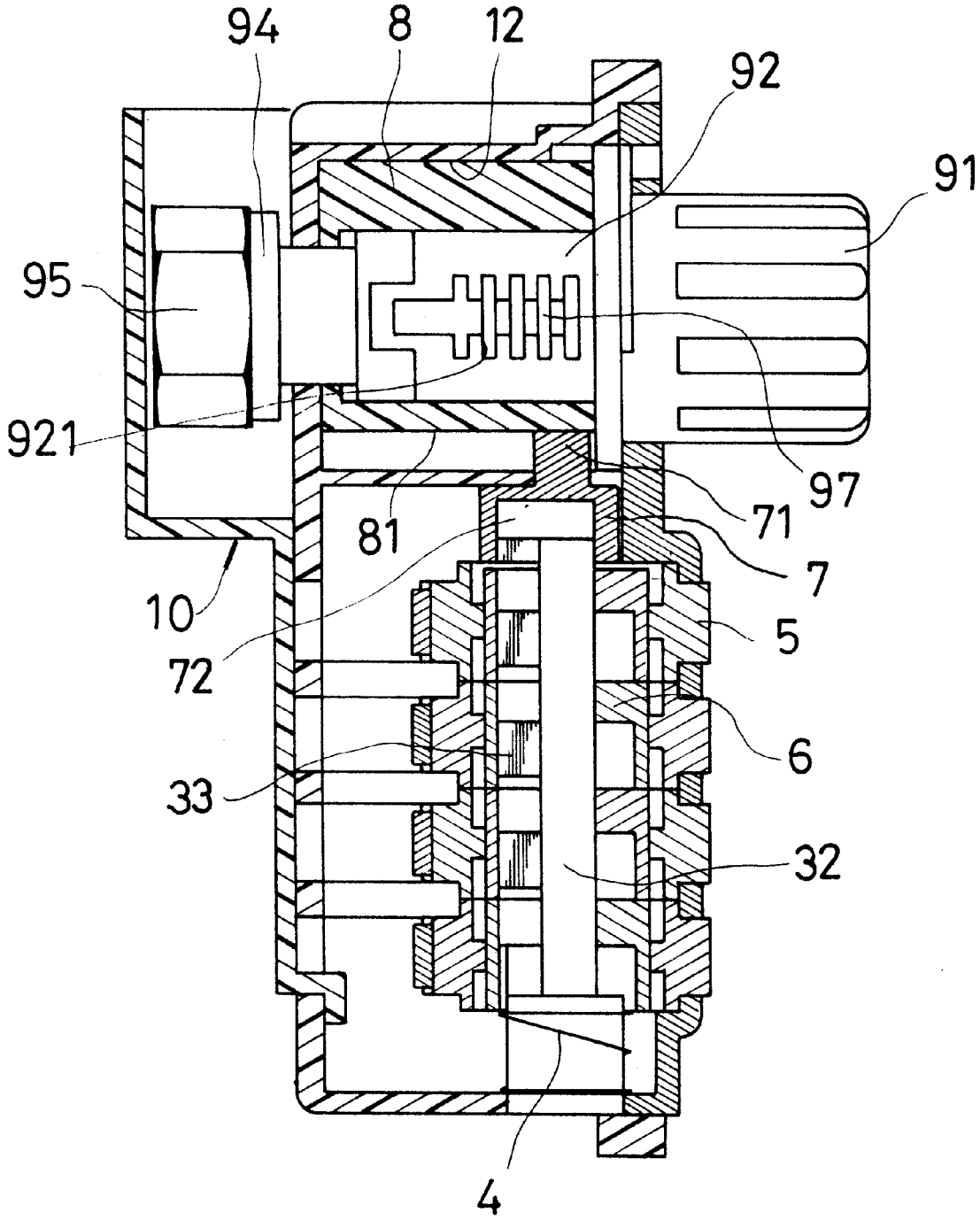
FIG. 9 is a side view of the combination lock of the present invention in the locked position.
Figure 11:
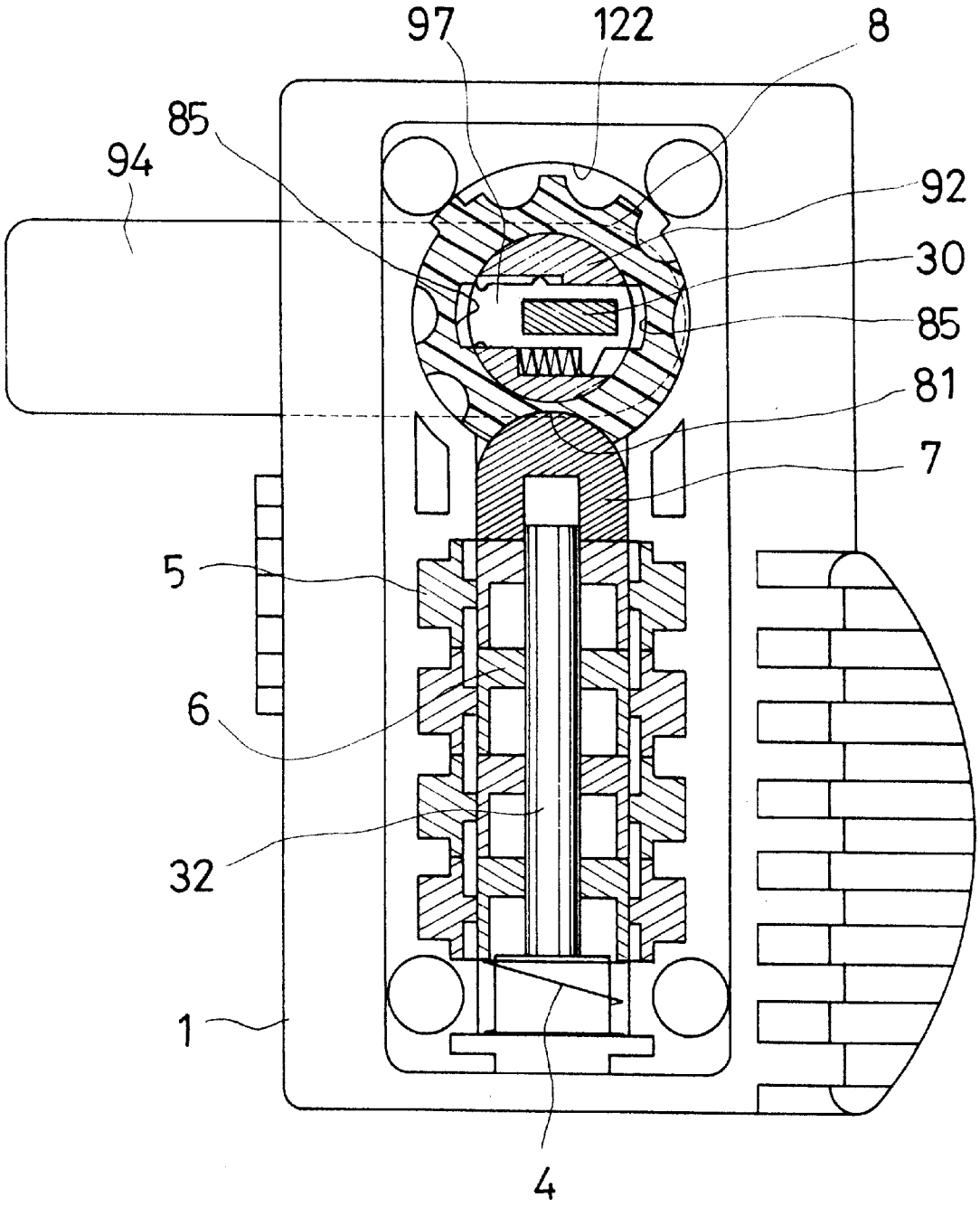
FIG. 11 is a view of the combination lock being opened by the spare key.
Figure 12:
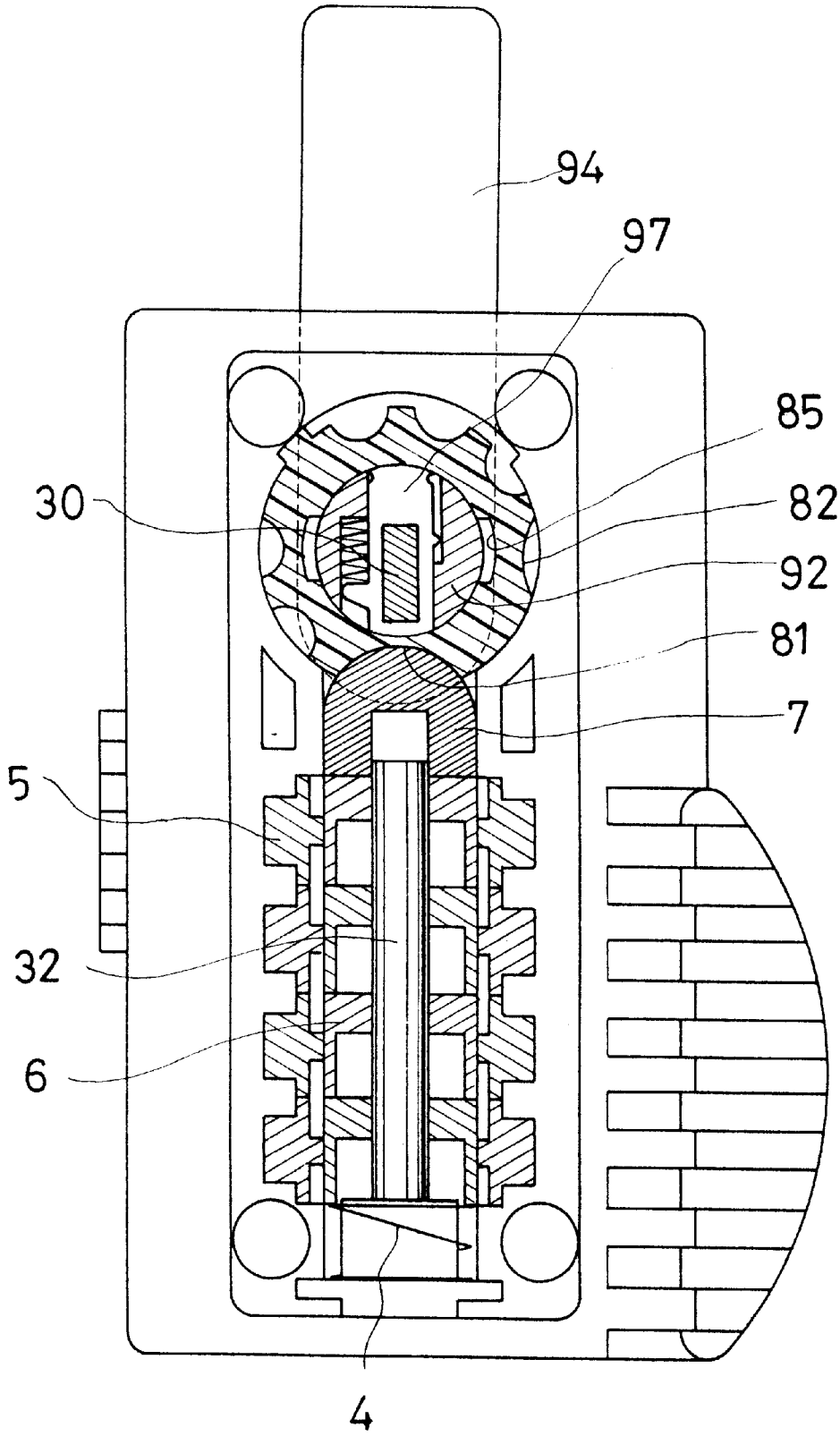
FIG. 12 another view of the combination lock being opened by the spare key.
Figure 13:
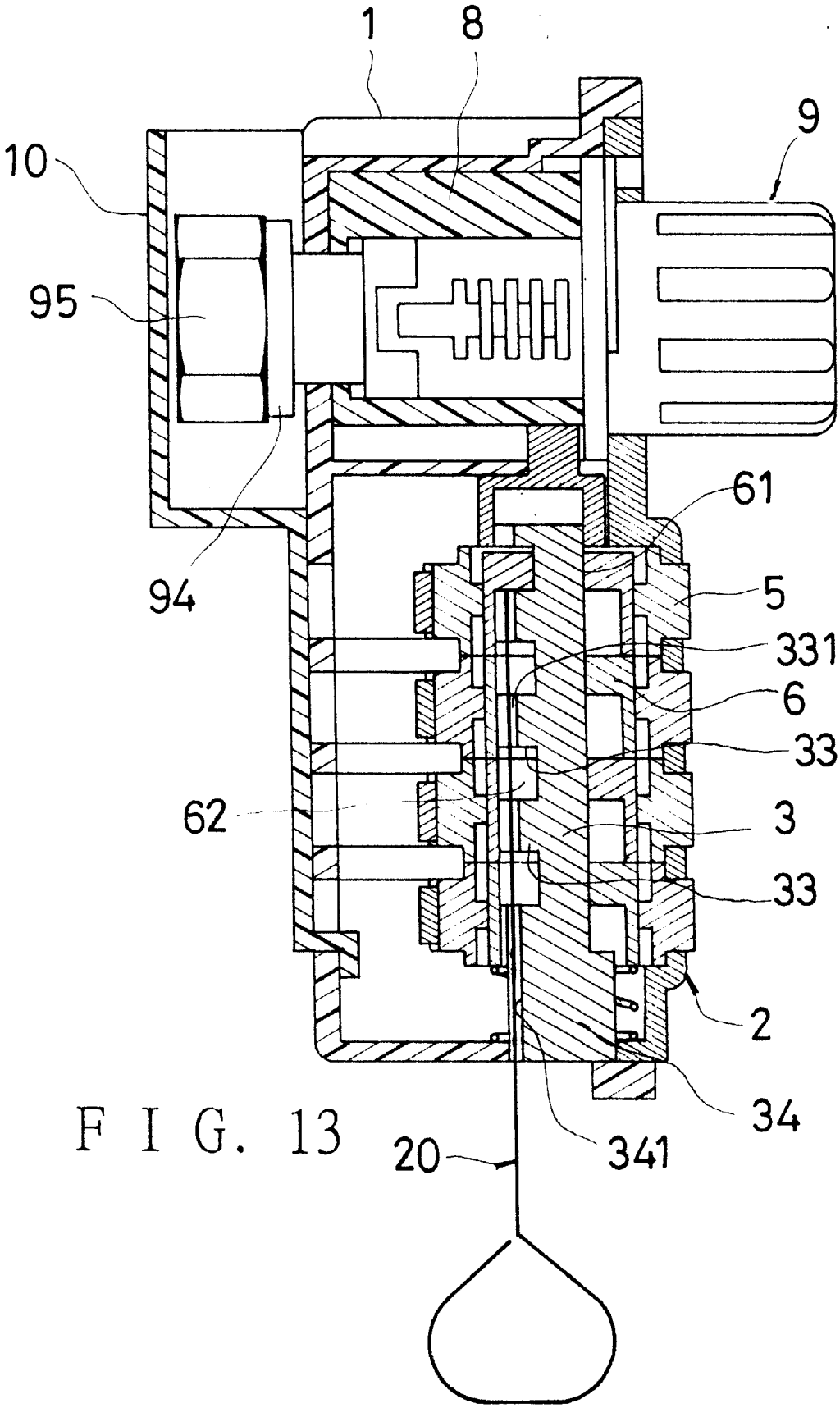
FIG. 13 is a view showing a probing needle being passed up through the passage for finding out the opening of the combination of numbers for the lock.

The operating rod 9 includes a knob portion 91 at the front end, a rod-shaped portion 92 at the middle, and a connecting portion 93 at the rear end. The middle portion 92 has a slot (not numbered), which has several insertion trenches 921 on one lateral side and round trenches 922 opposing the insertion trenches on the other side as shown in FIGS. 1, 4 and 9; the insertion trenches 921 are formed in such a manner as to communicate with each other, while the round trenches 922 don't communicate with each other. The knob portion 91 has a keyhole 98 communicating with the slot of the middle rod-shaped portion 92. Referring to FIG. 4, the insertion trenches 921 and the opposing round trenches 922 have insertion plates 97 fitted thereonto; the insertion plates 97 each has an elongated hole 971, a stopping portion 972 received in the corresponding round trench 922, and a tooth 973 received in the corresponding insertion trench 921; springs 96 are disposed in the round trenches 922 to contact the stopping portion 972 so as to bias the insertion plates 97 outwardly of the slot of the middle portion 92; the teeth 973 will be blocked by the ends of the insertion trenches 921 when the springs 96 bias the plates 97 outwards such that the plates 97 can't fall off. The connecting portion 93 is shaped like a cylinder with two opposite straight sides, and has threads 931 on the curved sides.

The operating rod 9 is passed through the round hole 23 of the panel 2, and the central hole 84 of the control block 8 from the middle portion 92 thereof such that the insertion plates 97 will be biased by the springs 96 to engage the inner trenches 85 of the block 8 when the ends thereof oppose the inner trenches 85. The rear connecting portion 93 sticks out from the control block 8, and is passed through a rectangular hole of a locking plate 94, which is disposed in the recess 101 of the back board 10; a nut is screwed onto the connecting portion 93 to prevent the locking plate 94 from moving relative to the same.

When a user wants to use a depository cabinet with the lock of the present invention, he should find out whether the cabinet is in use or not by means of looking through the inspecting hole 24 of the front panel 2 to find the position of the locking plate 94; if the cabinet is not in use, the locking plate 94 will be upright, i.e. it can be seen by the user. Referring to FIGS. 4 to 7, when the combination lock is opened, i.e. the square portions of all of the control rings 6 are aligned with the projections 33 of the lock rod 3, the user can turn the operating rod 9 such that the second concavely curved portion 82 of the control block 8 is mounted on the propping block 7 to press the block 7 downwards; thus, the control rings 6 are separate from the wheels 5, allowing the orientation of the control rings 6 in relation to the wheels 5 to be changed when the wheels 5 are turned by the user. Thus, the combination of numbers capable of opening the lock can be reset by the present user. The user then turns the operating rod 9 such that the locking plate 94 is moved to a laid down position and the first concavely curved portion 81 is mounted on the propping block 7; because of the depth of the first portion 81, the control rings 6 plus the propping block 7 are biased up by the spring 4, and the control rings 6 engage the wheels 5 again from the spaced engaging projections 62. The lock plate 94 prevents the cabinet door from being opened that is in the laid down position, and the projections 33 of the lock rod 3 stop the control rings 6 from being moved down after the wheels 5 have been turned away from the combination of numbers capable of opening the lock. Therefore, the propping block 7 is fixed in position to engage the first concavely curved portion 81, preventing the control block 8 from being turned; in other words, the locking plate 94 can't be turned back to the upright unlocked position.

When the present user wants to open the lock to withdraw the things deposited in the cabinet, he only has to turn the wheels 5 to the unlocking position according to the combination of numbers that he set, and turn the operating rod 9 to make the locking plate 94 move to the upright position such that the cabinet door becomes openable.

If the user forgets the unlocking combination of numbers, the user has to have the lock opened by a spare key 30 kept in the counter, when the spare key is inserted into the keyhole 98 and the elongated holes 971 of the insertion plates 97 received in the middle portion 92, the insertion plates 97 will be moved so as to disengage the inner trenches 85 of the control block 8, allowing the operating rod 9 and the locking plate 94 to be turned with the control block 8 being still fixed in position for opening the cabinet door.

After the cabinet door is opened, the counter staff has to pass a probing needle 20 into the upright passage 331 in order to find out the forgotten opening combination of numbers that is set by the last user, if the upper end of the probing needle 20 is blocked by the control rings 6, he has to turns the wheels 5 connected to the control rings 6 to such a position that the probing needle 20 can be moved through the passage 331. Thus, the combination lock is opened again so that the next user can make the control block 8 turn to press the control rings 6 down for resetting his opening combination of numbers by means of the wheels 5.

Furthermore, the convexly curved blocks 141 provided at the ends of the flexible legs 14 can be fitted onto the curved recesses 52 of the wheels 5 such that the user can exactly turn the wheels 5 to the positions where the lock can be opened.

From the above description, it can be easily understood that the lock of the present invention has advantages as followings:

1. Every user can set a combination of numbers that only he knows so that his belongings can be safely deposited in the cabinet. There is no risk of losing a key or possibility of early users opening the lock with old unlocking combination of numbers.
2. Should the present user forget the combination of numbers that he set, the cabinet door still can be opened with the spare key in the counter.
3. After the cabinet door is opened with the spare key, the forgotten combination of numbers can be found out with the probing needle such that the lock still can be used with reset combination of numbers by other users.

What is claimed is:

1. A combination lock used for a depository cabinet in public places, comprising a housing member having a plurality of wheels turnably disposed therein that are each marked with spaced numerals on an outer side; said wheels each having at least a portion sticking out from a panel joined to a front side of said housing member; said housing member being secured to a door of a depository cabinet;

a plurality of control rings, said control rings being each separably received in a respective one of said wheels; said control rings each having spaced engaging projections on an outer side to engage spaced engaging teeth formed on an inner side of said wheel when same is received in said wheel; said control rings each having a through hole formed with both a central round portion and a square portion;

a lock rod, said lock rod being secured to a bottom of said housing member from a lower portion and passed through said control rings forming a rod part; said lock rod having projections sticking rearwards and spaced along said rod part so as to engage a respective one of said square portions of said ring round holes when said rings are moved to be separate from said wheels; said projections each having a gap extending from a top to a bottom; said control rings being turnable together with said wheels when same are received in said wheels due to engagement between said projections thereof and said wheel teeth; a first spring being disposed under a lowermost one of said control rings to bias all of said rings up for same to engage said wheels;

a control block, said control block having a central hole lengthwise formed therein and a plurality of concavely curved portions lengthwise formed on an outer side thereof; said concavely curved portions including a first one and a second one that is shallower than said first one; said control block being longwise and turnably passed through a hole of said panel and a holding room of said housing member formed above said wheels;

an operating rod, said operating rod being passed into said central hole of said control block from a middle rod portion; said operating rod having a front knob sticking out from said panel, and a rear end portion connected to a locking plate placed behind said housing member; said middle rod portion having a plurality of insertion plates received in a through trench lengthwise formed thereon; said insertion plates being each biased by a spring to stick out from said through trench to disengagably engage trenches formed on a wall of said central hole of said control block; said knob having a key hole communicating with, and aligned with, elongated holes formed on said insertion plates; and a holed propping block, said block being disposed on a top end of said lock rod to come into contact with an uppermost one of said control rings;

said knob being turnable between a locking position where said first concavely curved portion of said control block is moved onto said propping block and where said locking plate is in a laid down position to prevent said cabinet door from being opened and an unlocking position where said control rings are turned to such position together with said wheels as to be capable of being moved down along said lock rod for allowing said control block to be turned, thus allowing said locking plate to be moved to an unlocking upright position by means of turning said operating rod together with said control block; said control block being capable of pressing said control rings down against said first spring when same is turned to such a position as to mount on said propping block from said second concavely curved portion thereof.

2. The combination lock as claimed in claim 1, wherein said lock rod has gaps on said lower portion and said rear projections thereof; said gaps being aligned with each other to form an upright passage for allowing a probing needle to be passed up therethrough from a lower curved trench of said housing member so as to find out a present combination of numbers for opening the lock that was set by a user and is forgotten.

3. The combination lock as claimed in claim 1, wherein said insertion plates being each biased by a spring to stick out from said through trench of said wall of said control block; said insertion plates having elongated holes being disengaged from said trenches when a key therefore is inserted into said keyhole plus said elongated holes thereof, thus allowing said operating rod and said locking plate to be turned for opening said cabinet door without having to turn said control block.

4. The combination lock as claimed in claim 1, wherein said springs biasing said insertion plates out are each received in a round trench formed on one side of said lengthwise formed through trench of said middle rod portion, and said through trench has insertion trenches opposing said round trenches, while said insertion plates each has a stopping portion sticking out at one edge, and a tooth sticking out at an opposite edge; said stopping portions being passed into said round trench so as to be connected to, and biased by, said springs; said teeth of said insertion plates being fitted onto said insertion trenches for restricting movement of said insertion plates.

* * * * *